US005839021A

United States Patent [19]

Hayashi et al.

[11] Patent Number: 5,839,021

[45] Date of Patent: Nov. 17, 1998

[54] DEVELOPING UNIT FOR AN ELECTROPHOTOGRAPHIC PRINTER EMPLOYING A SUPPLY ROLLER FOR TRANSFERRING TONER TO A DEVELOPING ROLLER

[75] Inventors: Kuniharu Hayashi; Koichi Matsuzaki; Masamitsu Nagamine, all of Tokyo, Japan

[73] Assignee: Oki-Data Corporation, Tokyo, Japan

[21] Appl. No.: 897,273

[22] Filed: Jul. 21, 1997

[30] Foreign Application Priority Data

Jul. 24, 1996 [JP] Japan ..... 8-194825
Mar. 21, 1997 [JP] Japan ..... 9-067771

[51] Int. Cl.[6] ..... G03G 15/06; G03G 15/08

[52] U.S. Cl. ..... 399/55; 399/236; 399/281; 399/283

[58] Field of Search ..... 399/55, 236, 281, 399/283

[56] References Cited

U.S. PATENT DOCUMENTS 4,083,326 4/1978 Kroll et al. ..... 399/281
5,223,668 6/1993 Takaya et al. ..... 399/283 X

*Primary Examiner*—William J. Royer
*Attorney, Agent, or Firm*—Panitch Schwarze Jacobs & Nadel, P.C.

[57] ABSTRACT

The developing unit of an electrostatic printer is designed to avoid under-development of the bottom part of a dark latent image due to a reduction in recycled toner. This can be accomplished by providing the developing unit with one developing roller and at least two supply rollers. Alternatively, the developing unit has just one supply roller, but the rate at which toner is transferred from the supply roller to the developing roller can be switched. As another alternative, the supply roller and developing roller are designed to turn slowly enough that development of an entire page is completely developed before reaching the point where under-development would begin.

18 Claims, 16 Drawing Sheets

Vsp1 > Vdb

Vsp2 < Vdb

DEVELOPING UNIT FOR AN ELECTROPHOTOGRAPHIC PRINTER EMPLOYING A SUPPLY ROLLER FOR TRANSFERRING TONER TO A DEVELOPING ROLLER

BACKGROUND OF THE INVENTION

The present invention relates to the developing unit of an electrophotographic printer.

An electrophotographic printer forms a latent electrostatic image comprising charged and uncharged areas on an image surface such as the surface of a photosensitive drum. The developing unit develops the image by bringing charged particles of toner to the image surface, where the toner is repelled from or attracted to the image according to the presence or absence of charge on the image surface. The developed image is then transferred from the image surface to a printing medium such as a sheet of paper.

A conventional developing unit has a developing roller that transfers toner to the image surface, and a supply roller that brings toner from a toner reservoir to the developing roller. These rollers also recycle toner that is not transferred to the image surface: most such toner is returned from the developing roller to the supply roller, then resupplied from the supply roller to the developing roller.

A consequent problem is that when a dark image is developed, the bottom part of the image is under-developed. Since most of the toner on the developing roller is transferred to the image surface, little toner is left to be recycled, so Less toner is brought to the bottom part of the image than to the top part. A more detailed description of this problem will be given below.

SUMMARY OF THE INVENTION

It is accordingly an object of the present invention to develop a latent electrostatic image uniformly throughout the length of the image.

A further object is to develop latent images uniformly on a series of pages.

According to a first aspect of the invention, a developing unit for developing a latent electrostatic image has one developing roller and at least two supply rollers. All supply rollers make sliding contact with the developing roller.

Depending on the amount of toner removed from the developing roller to develop the latent electrostatic image, the amount of toner adhering to the developing roller may vary greatly in the area ahead of the first supply roller, but the variation is reduced by the first supply roller. The variation is therefore reduced still more by the second supply roller, and by any subsequent supply rollers. After passing all of the supply rollers, the developing roller carries an amount of toner that is substantially independent of the darkness of the image area developed so far, and the uniformity of the developing process is improved.

The supply rollers in the first aspect of the invention may all turn in the same direction, or they may turn in different directions, to reduce the necessary driving torque. The supply rollers may all be biased at the same electrical potential, or they may be biased at different potentials.

According to a second aspect of the invention, the developing unit has only one supply roller, but the rate of toner transfer from the supply roller to the developing roller is switchably controlled. The rate can be controlled by switching the bias potential of the supply roller, for example, or by switching the rotational speed of the supply roller. When an image is developed, the switching is carried out just at the time when the developing roller begins to receive less recycled toner from the supply roller because of a preceding transition from light to dark in the image.

According to a third aspect of the invention, the developing unit is designed so that the sum of one rotational period of the developing roller and one rotational period of the supply roller equals or exceeds the time needed to develop an image on one full page of the maximum length allowed by the printer in which the developing unit is installed. Any change in the amount of toner brought to the image surface therefore takes place after the entire image has been developed.

The second and third aspects of the invention can be combined, thereby avoiding both variations in the development of different parts of the same page, and variations from one page to the next.

DETAILED DESCRIPTION OF THE INVENTION

First, a fuller description of the problem addressed by the present invention will be given.

Figure 1:
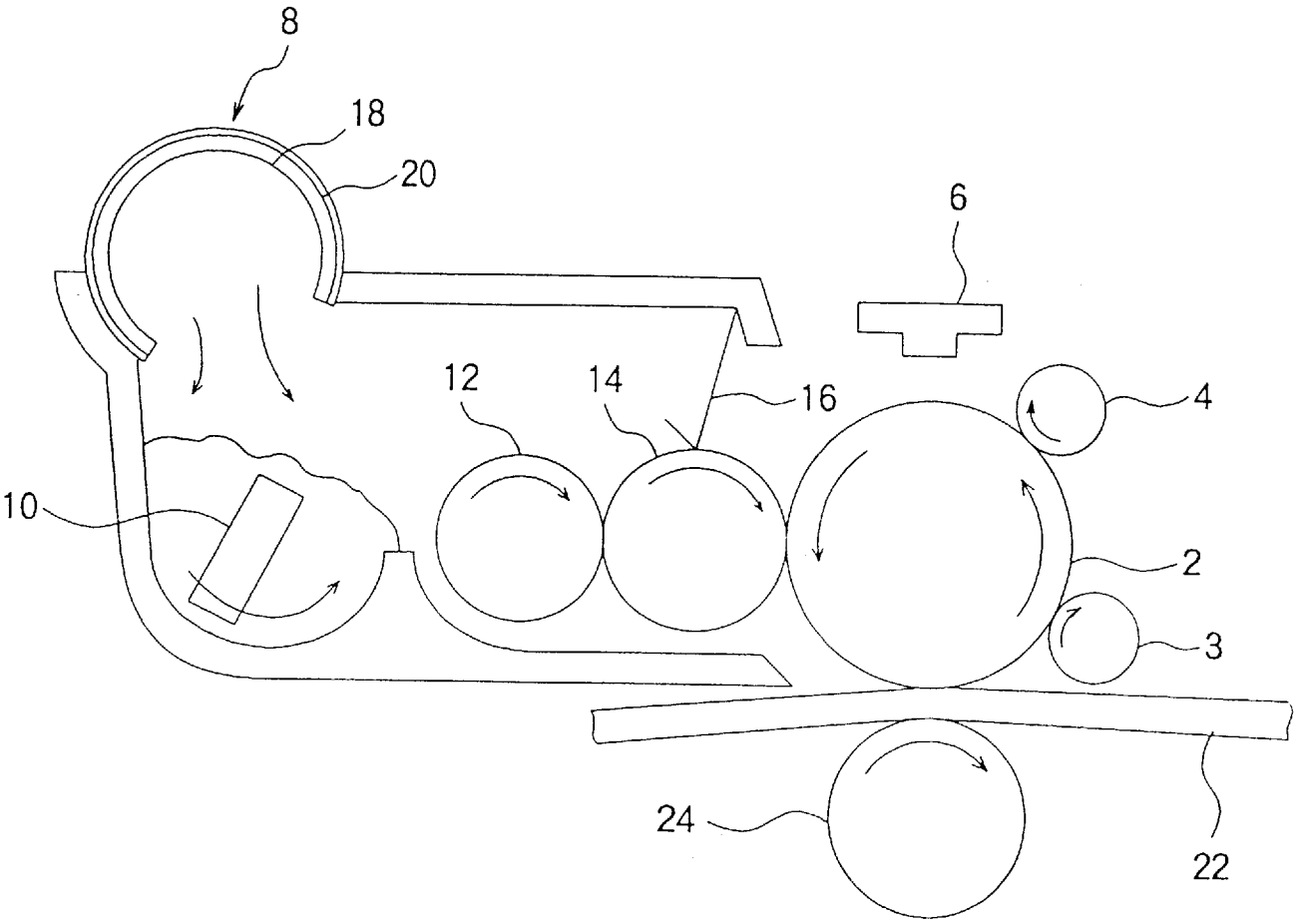
(PRIOR ART) FIG. 1
FIG. 1 shows a cutaway side view of a conventional developing unit.

FIG. 1 shows part of an electrophotographic printer having a conventional developing unit. The printer comprises a photosensitive drum 2, a cleaning roller 3 that cleans the photosensitive drum 2, a charging roller 4 that charges the surface of the photosensitive drum 2 to a uniform negative potential, and an optical printing head 6 such as a light-emitting-diode (LED) printing head. The charge on the surface of the photosensitive drum 2 escapes from areas illuminated by the optical printing head 6, leaving these areas at substantially the ground potential and creating a latent electrostatic image.

The developing unit in the printer comprises a toner cartridge 8, a stirrer 10, a supply roller 12, a developing roller 14, and a blade 16. The toner cartridge 8 comprises two concentric slotted cylinders 18 and 20. When the slots are aligned as shown, toner falls into a reservoir below, to be stirred by the stirrer 10 and thus applied to the supply roller 12, then transferred to the developing roller 14. During this process, the toner acquires a negative charge. The blade 16 presses against the developing roller 14 with a constant pressure and removes excess toner.

The amount of toner removed by the blade 16 depends both on the pressure exerted by the blade 16 and the relative electrical charges of the toner 16 particles and developing roller 14. The blade 16 removes toner particles having less than a certain charge. The blade 16 thus reduces the problem of fogging, which occurs when inadequately charged toner particles are transferred to image areas that should be white.

The negatively-charged toner is carried by the developing roller 14 to the photosensitive drum 2, and transferred to the uncharged areas on the photosensitive drum 2, thereby developing the latent electrostatic image. The developed image is transferred to the printing medium 22 by a positively charged transfer roller 24.

Figure 2:
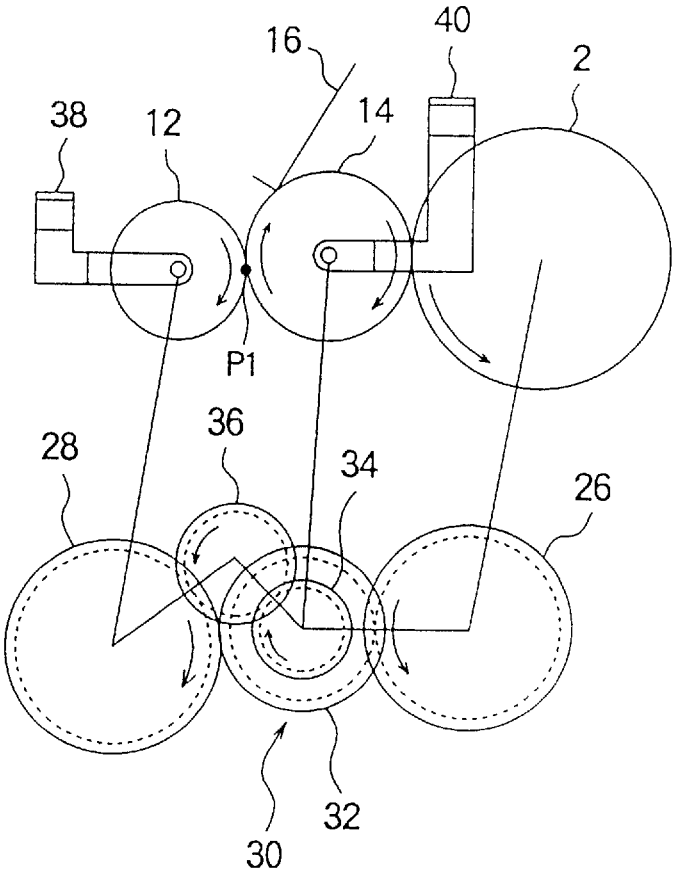
FIG. 2 (PRIOR ART)
FIG. 2 illustrates the gears that drive the supply roller and developing roller in FIG. 1.

FIG. 2 schematically illustrates the drum gear 26, supply gear 28, and developing gear 30 that are affixed to the shafts of the photosensitive drum 2, supply roller 12, and developing roller 14, respectively. For clarity, the gears are shown detached from these shafts. The developing gear 30 is a double gear having a large-radius toothed component 32 that meshes with the drum gear 26, and a small-radius toothed component 34 that meshes with an idle gear 36. The idle gear 36 meshes in turn with the supply gear 28. When the photosensitive drum 2 is driven counterclockwise, these gears turn the supply roller 12 and developing roller 14 clockwise. Since the supply roller 12 and developing roller 14 both turn clockwise, Considerable sliding friction is produced at their point of contact P1.

FIG. 2 also illustrates a pair of electrical contacts 38 and 40 by which the supply roller 12 and developing roller 14 are electrically biased. The supply roller 12 is biased at a certain negative potential. The developing roller 14 is biased at a smaller negative potential. The power supplies that, produce these bias potentials are omitted from the drawing.

Figure 3:
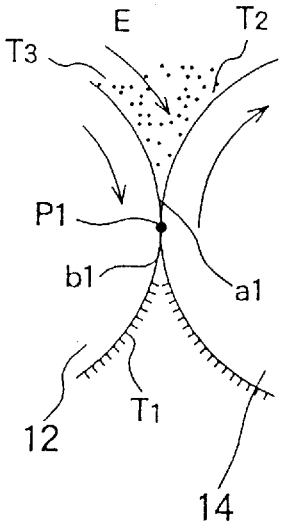
FIG. 3 (PRIOR ART)
FIG. 3 illustrates the transfer of toner between the supply roller and developing roller.

FIG. 3 illustrates the transfer of toner around point P1 in FIG. 2.

Toner is transferred from the supply roller 12 to the developing roller 14 at a point a1 just above the point of contact P1. Due to the negative bias of the rollers and the friction between them, the toner particles acquire a strong negative charge at this point. Electrically charged toner particles, indicated by short lines, that still adhere to the developing roller 14 after being carried past the photosensitive drum 2 are mostly removed from the developing roller 14 at a point b1, just below the point of contact P1, and most of the removed toner clings to the supply roller 12. This toner $T_1$ is brought around by the rotation of the supply roller 12 and arrives again at point a1, to be transferred once more to the developing roller 14 and added to the toner $T_2$ that was not removed at point b1.

The supply roller 12 also picks up new toner at the toner reservoir, and the rotation of the supply roller 12 brings this new toner $T_3$ to the transfer point a1, as indicated by arrow E. The total amount of toner supplied to the developing roller 14 is therefore the sum of three quantities: $T_1+T_2+T_3$.

The amount of toner transferred between the supply roller 12 and developing roller 14 depends on the bias potentials of these rollers, more specifically on the difference between the bias potentials. The difference between the two bias potentials is conventionally about minus two hundred fifty volts (−250 V).

Figure 4:
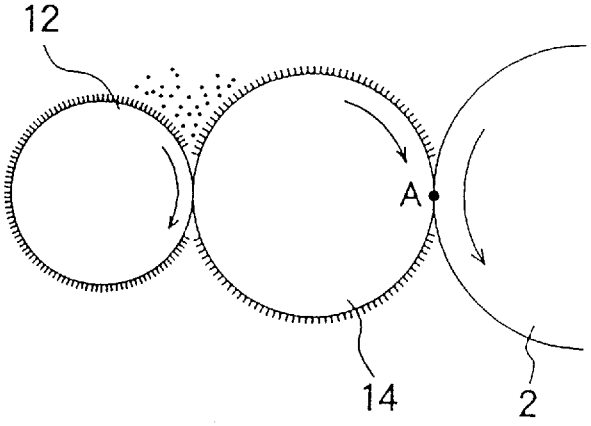
FIG. 4 (PRIOR ART)
FIG. 4 illustrates the start of the development of an all-black image.

FIG. 4 illustrates the state at the beginning of the development of an all-black image. The supply roller 12 and developing roller 14 both carry a normal load of charged toner particles acquired during a preceding rotation (not illustrated) that did not develop a dark image. Transfer of toner to the photosensitive drum 2 starts at the point A on the developing roller 14 that meets the top of the all-black latent image.

Figure 5:
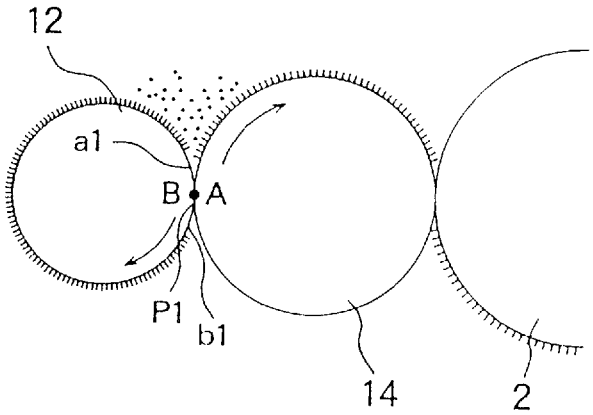
FIG. 5 (PRIOR ART)
FIG. 5 illustrates a later state in the development of an all-black image.

FIG. 5 illustrates the state after the developing roller 14 has made one half-turn, bringing point A into contact with point B on the supply roller 12. The return of recycled toner from the developing roller 14 to the supply roller 12 ceases here, because substantially all of the toner has been transferred to the photosensitive drum 2. For the same reason, the quantity $T_2$, representing the amount of toner not removed at point b1, becomes substantially equal to zero. The amount of toner supplied at point al is thus reduced to substantially $T_1+T_3$.

Figure 6:
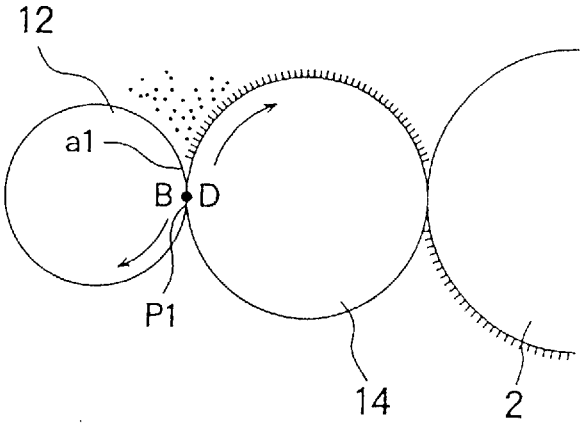
FIG. 6 (PRIOR ART)
FIG. 6 illustrates a still later state in the development of an all-black image.

FIG. 6 illustrates the state when the supply roller 12 has made one full turn from the state in FIG. 5, bringing point B back into contact with the developing roller 14 at point D. The amount of toner supplied at point a1 is now reduced to substantially $T_3$, because $T_1$ is substantially zero. After the developing roller 14 makes one more half-turn, bringing point D adjacent the photosensitive drum 2, only this reduced amount of toner ($T_3$) will be available for transfer to the photosensitive drum 2.

Let La be the distance traveled by a point on the circumference of the photosensitive drum 2 during one rotational period of the developing roller 14. Let Lb be the distance traveled by a point on the circumference of the photosensitive drum 2 during one rotational period of the supply roller 12. The rotational period of a roller is the time taken by the roller to make one full turn. The darkness of the developed image changes at a distance equal to La from the top of the image due to the disappearance of $T_2$, and changes again at a distance equal to La+Lb from the top of the image due to the disappearance of $T_1$. The change at La is normally not noticeable on the printed page, because the quantity $T_2$ is small to begin with, but on dark pages, the change at. La+Lb is readily discernible.

First embodiment

Figure 7:
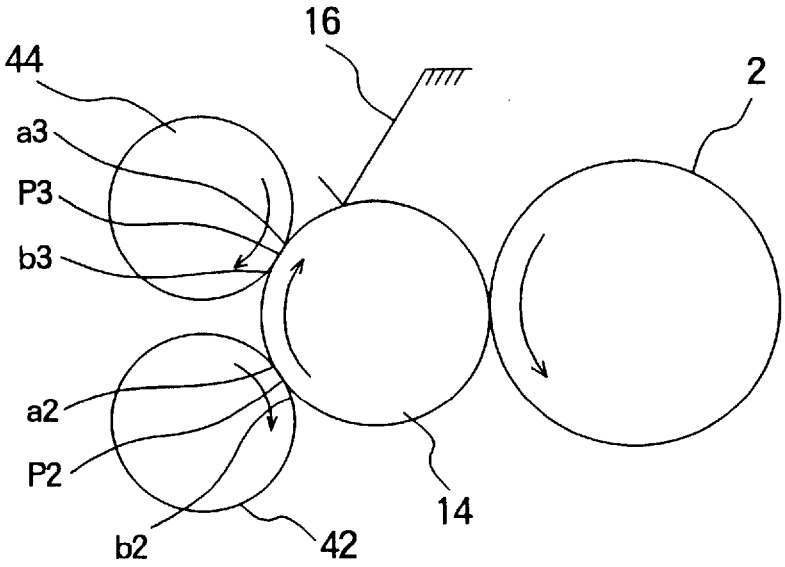
FIG. 7 schematically illustrates a first embodiment of the invention.

FIG. 7 shows the first embodiment schematically, using the same reference numerals as in FIG. 1 for the photosensitive drum 2, developing roller 14, and blade 16. Exemplifying the first aspect of the invention, the first embodiment has two supply rollers 42 and 44. Both supply rollers 42 and 44 are made of a silicone sponge-rubber material and turn clockwise. The developing roller 14 is made of urethane rubber and also turns clockwise. The supply rollers 42 and 44 meet the developing roller 14 at points P2 and P3 with a half-millimeter (0.5 mm) nip or bite. The developing roller is electrically biased at −300 V. The supply rollers 42 and 44 are electrically biased at −550 V.

The first supply roller 42 removes toner from the developing roller 14 at point b2 and supplies toner to the developing roller 14 at point a2. Similarly, the second supply roller 44 removes toner from the developing roller 14 at point b3 and supplies toner to the developing roller 14 at point a3. As in a conventional developing unit, the toner supplied at points a2 and a3 includes both new toner brought from a toner reservoir (not visible), and recycled toner that was removed at points b2 and b3.

Figure 8:
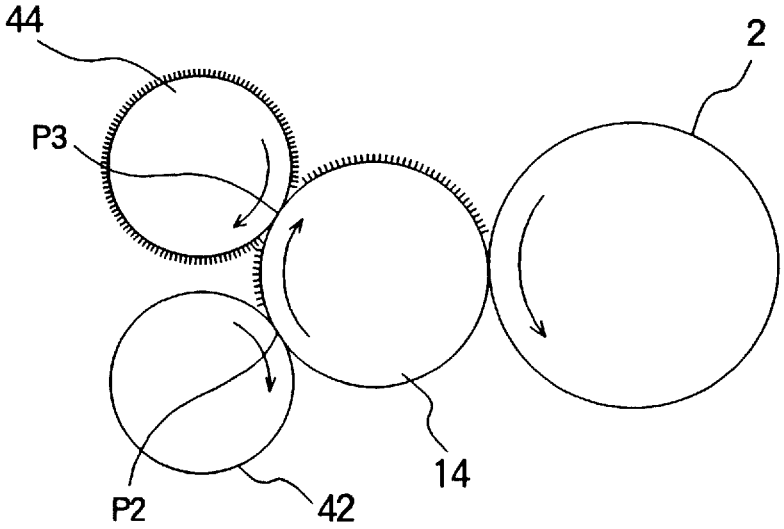
FIG. 8 illustrates the operation of the first embodiment in printing an all-black image.

FIG. 8 illustrates the operation of the first embodiment when printing an all-black page, at a point near the bottom of the page. Substantially all of the toner on the developing roller 14 is transferred to the photosensitive drum 2, and substantially no toner remains on the developing roller 14 in the area between the photosensitive drum 2 and point P2. The first supply roller 42 supplies new toner from the toner reservoir, however, so the developing roller 14 has close to a normal load of toner in the area between points P2 and P3. This toner is mostly removed by the second supply roller 44, carried around, and resupplied just above point P3, together with more new toner from the toner reservoir.

Thus, even if the image being developed is completely black, the second supply roller 44 is able to supply both new toner from the toner reservoir and recycled toner that was supplied just above point P2 and removed just below point P3. The amount of toner that the developing roller 14 carries away from point 13 depends mainly on the amount of new toner supplied by the supply rollers 42 and 44, which is substantially constant, and depends very little on the variable amount of toner on the developing roller 14 before point P2. Accordingly, all parts of the image receive substantially the same amount of toner, and no part of the image is under-developed.

In the printing of various types of images, the amount of toner on the developing roller 14 before point P2 varies from substantially zero for an all-black image to one hundred percent for an all-white image. By removing old toner and supplying new toner, however, the first supply roller 42 reduces this one-hundred-percent variation to a fraction of one hundred percent. The second supply roller 44 then reduces the variation to a fraction of that fraction, largely eliminating the variation.

Figure 9:
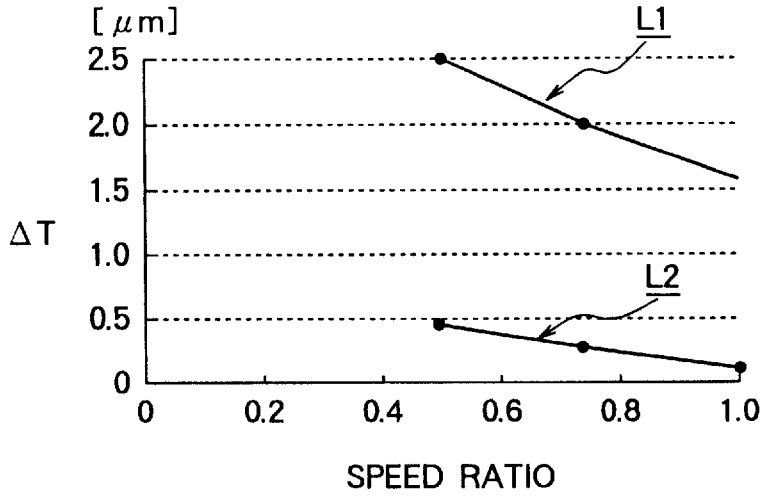
FIG. 9 is a graph comparing uniformity characteristics of the first embodiment and the conventional developing unit.

FIG. 9 shows the measured variation in terms of the thickness of the toner layer on the developing roller 14. The difference in thickness (ΔT) caused by a transition from all-white to all-black developing is shown in micrometers (μm) on the vertical axis. The horizontal axis indicates the ratio of the rotational speed of the supply rollers to the rotational speed of the developing roller. A conventional developing unit with one supply roller yielded the data on line L1. The first embodiment, with two supply rollers, yielded the data on line L2, showing an improvement of nearly an order of magnitude in the uniformity of the toner layer.

The first embodiment can be varied by providing more than two supply rollers. Each additional supply roller further reduces the thickness variation (ΔT) in the toner layer left on the developing roller 14.

The first embodiment prevents both non-uniform development within a single image, and non-uniform development from page to page when images on a series of pages are developed.

Second embodiment

Figure 10:
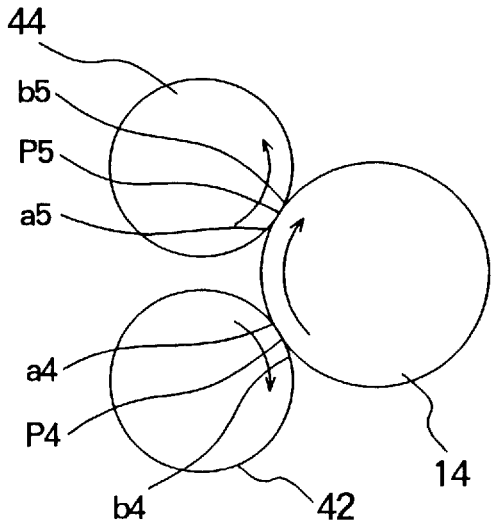
FIG. 10 schematically illustrates a second embodiment of the invention.

Referring to FIG. 10, the second embodiment is similar to the first embodiment in having two supply rollers 42 and 44, but while the first supply roller 42 and developing roller 14 turn clockwise, the second supply roller 44 turns counter-clockwise. Less sliding friction is therefore produced at the point of contact P5 between the second supply roller 44 and developing roller 14 than at the point of contact P4 between the first supply roller 42 and developing roller 14.

The first supply roller 42 removes toner from the developing roller 14 at point b4, and supplies toner to the developing roller 14 at point a4. If the rollers are driven at a speed ratio such that a point on the surface of the second supply roller 44 moves faster than a point on the surface of the developing roller 14, then the second supply roller 44 supplies toner to the developing roller 14 at point a5, and removes toner at point b5. More toner is supplied at point a5 than is removed at point b5, because the second supply roller 44 has a greater negative electrical bias than the developing roller 14.

If the rollers are driven at a speed ratio such that a point on the surface of the second supply roller 44 moves more slowly than a point on the surface of the developing roller 14, then the second supply roller 44 removes toner at point a5 and supplies toner at point b5. In either case, the toner is charged by friction generated at points P4 and P5.

Regardless of the speed ratio, the operation of the second embodiment is basically similar to the operation of the first embodiment. Since the first supply roller 42 supplies new toner to the developing roller 14, even when an all-black image is developed, the developing roller 14 carries toner between points P4 and P5. The variation in the thickness of the toner layer on the developing roller 14 after point P5 is thereby reduced, as compared with a developing unit having only one supply roller.

Figure 11:
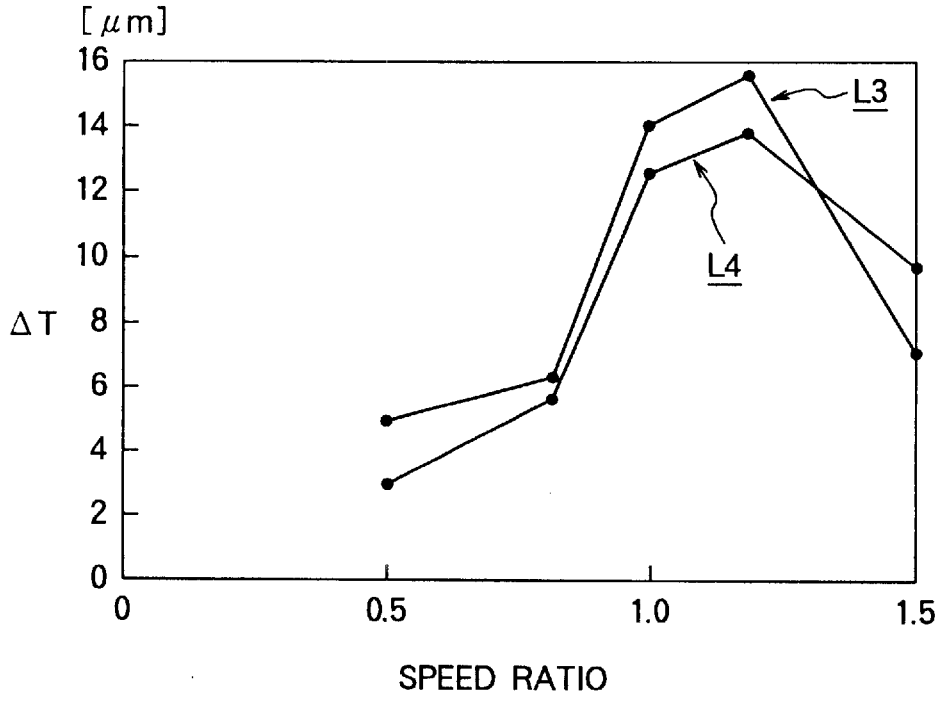
FIG. 11 is a graph of uniformity characteristics obtained with a supply roller and developing roller turning in different directions.

FIG. 11 shows the effects of roller speed and nip when the second supply roller 44 turns in the opposite direction from the developing roller 14, as in the second embodiment. To accentuate these effects, the data shown in FIG. 11 were measured with the first supply roller 42 removed. The horizontal axis indicates the ratio of the rotational speed of the second supply roller 44 to the rotational speed of the developing roller 14. The vertical axis indicates the toner thickness variation (ΔT). The data on line L3 were taken with a nip of 0.5 mm between the second supply roller 44 and the developing roller 14. The data on line L4 were taken with a nip of 0.29 mm. The least thickness variation was obtained with a speed ratio of 0.5 and a nip of 0.5 mm.

Figure 12:
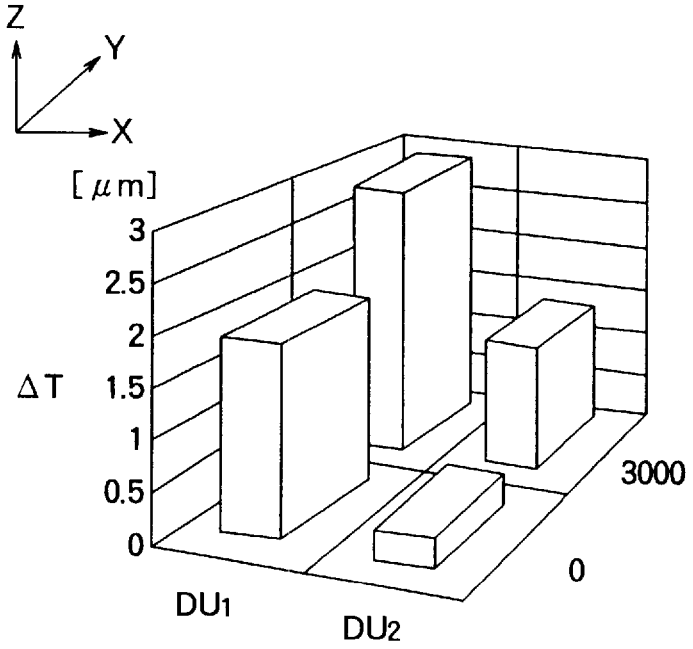
FIG. 12 is a graph comparing uniformity characteristics of the second embodiment and the conventional developing unit.

FIG. 12 compares the second embodiment with a conventional developing unit having only one supply roller. The comparison was made during the printing of three thousand pages in an electrophotographic printer, with a speed ratio of 0.5 and nip of 0.5 mm. The thickness variation (ΔT) is shown on the vertical axis or Z-axis. The Y-axis indicates the number of pages printed. The X-axis distinguishes between the conventional developing unit ($DU_1$) and the second embodiment ($DU_2$). As the data show, the second embodiment significantly reduces the thickness variation (ΔT), especially at the beginning of the series of pages.

The advantage of the second embodiment, as compared with the first embodiment, is that less torque is needed to drive the rollers, because friction between the second supply roller 44 and developing roller 14 is reduced. The second embodiment can therefore be powered by a smaller and less expensive motor, and the durability requirements for gears and other components can be relaxed, so the cost of the developing unit can be reduced.

Third embodiment

Figure 13:
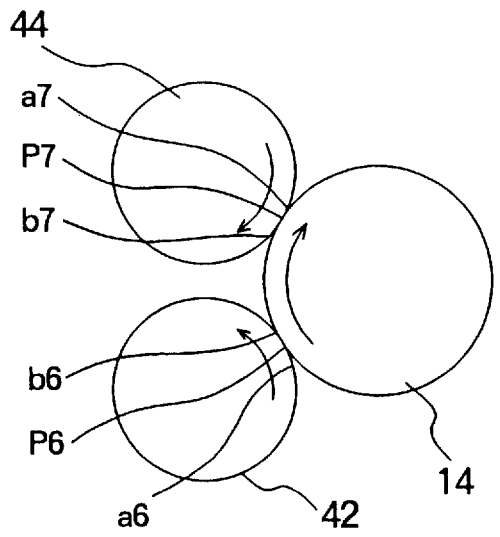
FIG. 13 schematically illustrates a third embodiment of the invention.

Referring to FIG. 13, the third embodiment is similar to the second embodiment in that the two supply rollers 42 and 44 turn in opposite directions, but in the third embodiment, the second supply roller 44 and developing roller 14 turn clockwise, while the first supply roller 42 turns counterclockwise. The first supply roller 42 supplies new toner at point a6, charges the toner by friction around point P6, and removes part of the toner at point b6. The second supply roller 44 removes toner at point b7, further charges the toner particles by friction around point P7, and supplies new toner at point a7.

The operation of the third embodiment is basically the same as in the first and second embodiments. By supplying and removing toner, the first supply roller 42 reduces the variation in thickness of the toner layer on the developing roller 14 between points P6 and P7, and the second supply roller 44 further reduces this variation. Since the two supply rollers 42 and 44 turn in opposite directions, less driving torque is required than in the first embodiment. In addition, the large amount of friction produced at point P7, where the second supply roller 44 and developing roller 14 slide against each other in opposite directions, gives the toner particles a greater charge than in the second embodiment, thereby reducing the degree of fogging in the developed image.

Figure 14:
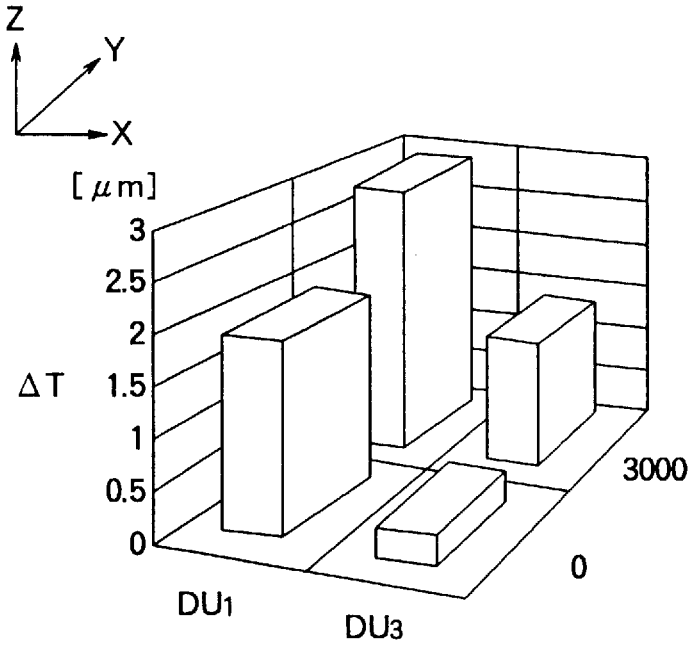
FIG. 14 is a graph comparing uniformity characteristics of the third embodiment and the conventional developing unit.

FIG. 14 compares the third embodiment ($DU_3$) with a conventional developing unit ($DU_1$) having only one supply roller, when the speed ratio is 0.5 and the nip between the supply and developing rollers is 0.5 mm. The X-, Y-, and Z-axes have the same meaning as in FIG. 12. Substantially the same improvement is seen as in the second embodiment.

Fourth embodiment

Figure 15:
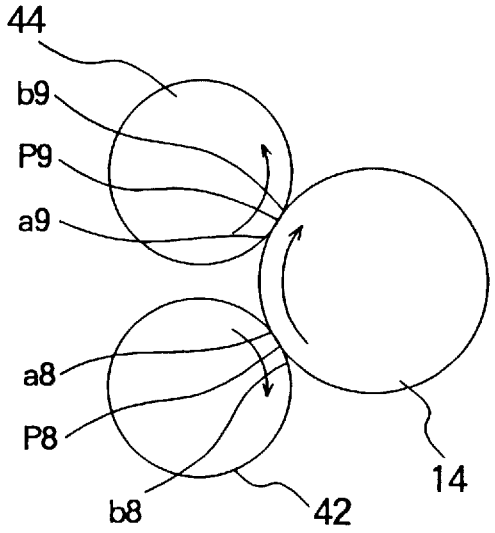
FIG. 15 schematically illustrates a fourth embodiment of the invention.

Referring to FIG. 15, the fourth embodiment is similar to the second embodiment in that the first supply roller 42 and developing roller 14 turn clockwise while the second supply roller 44 turns counterclockwise. The first supply roller 42 removes toner from the developing roller 14 at point b8, charges the toner by friction around point P8, and supplies toner at point a8. The second supply roller 44 supplies toner at point a9, charges the toner by friction around point P9, and removes toner at point b9.

In the fourth embodiment, the two supply rollers 42 and 44 are electrically biased at different potentials. The developing roller 14 is biased at a negative potential between the two bias potentials of the supply rollers 42 and 44. If Vsp1 is the bias potential of the first supply roller 42, Vsp2 is the bias potential of the second supply roller 44, and Vdb is the bias potential of the developing roller 14, then the relation among the bias potentials is:

$$Vsp2 < Vdb < Vsp1$$

Figure 16:
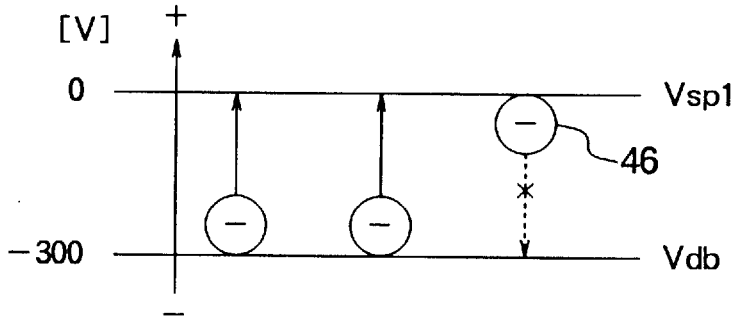
FIG. 16 illustrates the transfer of toner between the first supply roller and developing roller in the fourth embodiment.
Figure 17:
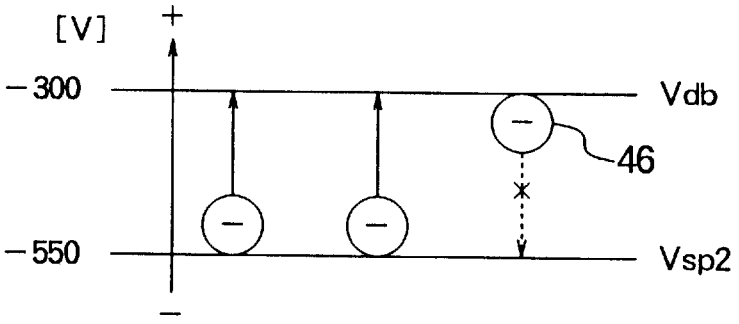
FIG. 17 illustrates the transfer of toner between the second supply roller and developing roller in the fourth embodiment.

For example, the following bias potentials can be used, as illustrated in FIGS. 16 and 17.

Vsp1=0 V

Vdb=−300 V

Vsp2=−550 V

The toner reservoir (not visible) is also negatively biased, so that the toner particles carry a negative charge. Referring to FIG. 16, the negatively charged toner particles 46 are readily transferred from the developing roller 14 (biased at −300 V) to the first supply roller 42 (biased at 0 V), but are not readily transferred in the opposite direction. Referring to FIG. 17, the toner particles 46 are readily transferred from the second supply roller 44 (biased at −550 V) to the developing roller 14 (biased at −300 V), but are not readily transferred in the opposite direction. The first supply roller 42 therefore mainly removes toner from the developing roller 14, and the second supply roller 44 mainly supplies toner to the developing roller 14.

Even though the first supply roller 42 does not supply much toner to the developing roller 14, by removing toner, the first supply roller 42 reduces the variation in the thickness of the toner layer on the developing roller 14 between points P8 and P9. After the second supply roller 44 supplies new toner, the variation is further reduced.

Figure 18:
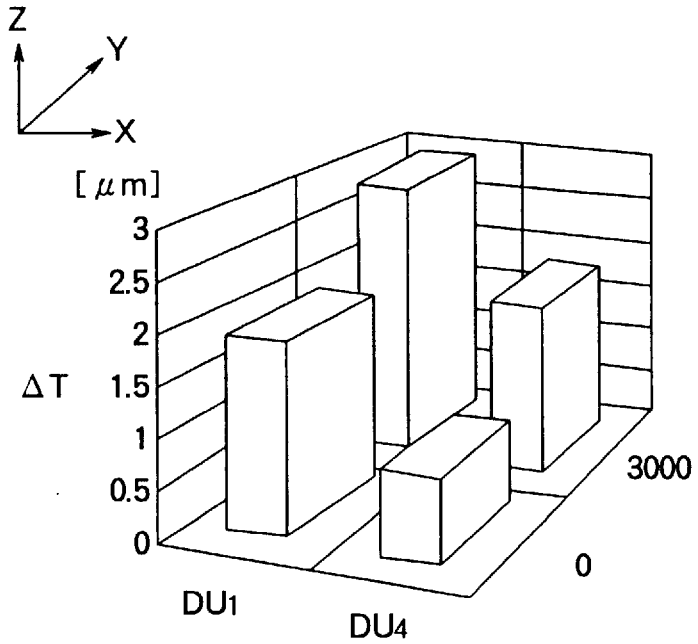
FIG. 18 is a graph comparing uniformity characteristics of the fourth embodiment and the conventional developing unit.

FIG. 18 compares the fourth embodiment ($DU_4$) with a conventional developing unit ($DU_1$) having only one supply roller, when the speed ratio is 0.5 and the nip between the supply and developing rollers is 0.5 mm. The X-, Y-, and Z-axes have the same meaning as in FIG. 12. The fourth embodiment also reduces the thickness variation (ΔT). The improvement is not as great as in the second embodiment, but the fourth embodiment demonstrates the feasibility of using one supply roller 42 mainly to remove toner from the developing roller 14.

Fifth embodiment

Exemplifying the second aspect of the invention, the fifth embodiment has only one supply roller, but provides a means of switching the bias potential of the supply roller. This means is controlled by electronic circuits in the electrophotographic printer in which the fifth embodiment is installed. The fifth embodiment thus comprises part of the printer's control circuitry.

Figure 19:
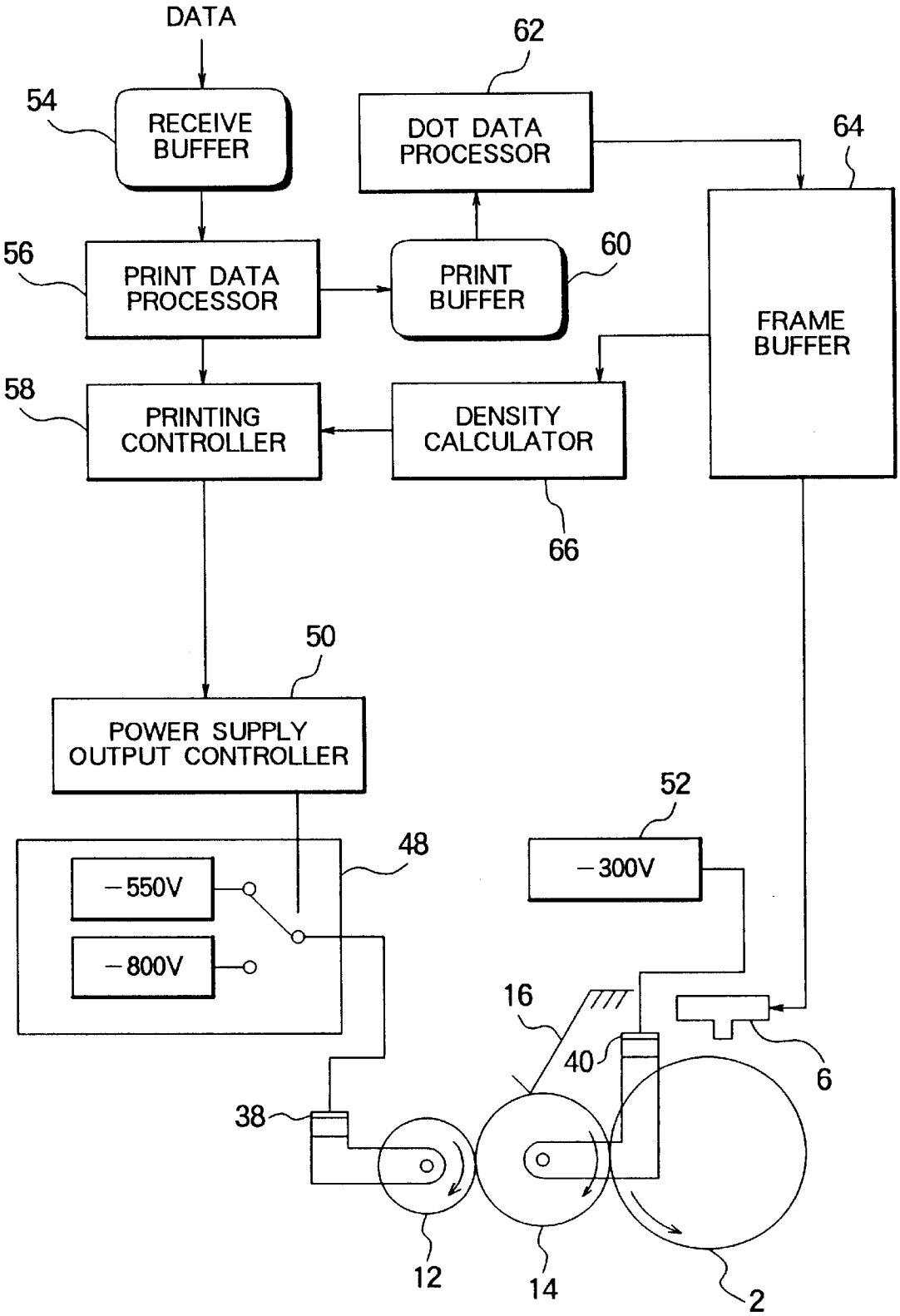
FIG. 19 schematically illustrates a fifth embodiment of the invention.

FIG. 19 illustrates the fifth embodiment, using the same reference numerals as in FIG. 1 for the supply roller 12, developing roller 14, blade 16, photosensitive drum 2, and optical printing head 6, and for the electrical contacts 38 and 40 by which the supply roller 12 and developing roller 14 are biased. The supply contact 38 is coupled to a dual-level power supply 48 that puts out either −550 V or −800 V under control of a power supply output controller 50. The developing contact 40 is coupled to a single-level power supply 52 that puts out −300 V.

The control circuits of the electrophotographic printer in which the fifth embodiment is installed comprise a receive buffer 54, a print data processor 56, a printing controller 58, a print buffer 60, a dot data processor 62, a frame buffer 64, and a density calculator 66. The receive buffer 54, print buffer 60, and frame buffer 64 comprise memory devices such as random-access semiconductor memory circuits. The print data processor 56, printing controller 58, dot data processor 62, and density calculator 66 may be separate processing circuits, or they may be separate software modules that are executed by a single processing circuit such as a microprocessor.

The receive buffer 54 receives input data from, for example, a computer or workstation. The print data processor 56 extracts print data, commands, and other input data from the receive buffer 54, processes each type of data as appropriate, and directs the operation of the printing controller 58. The printing controller 58 controls the power supply output controller 50 and other parts of the print engine, such as the motors (riot visible) that drive the photosensitive drum 2 and transport the printing medium.

The print buffer 60 stores print data such as character codes. The dot data processor 62 expands the print data into a bit map of the dots to be printed on each page, and stores the bit map in the frame buffer 64. The density calculator 66 reads the dot data from the frame buffer 64, calculates the proportion of black dots, and notifies the printing controller 58.

Next, the operation of the fifth embodiment will be described.

Figure 20:
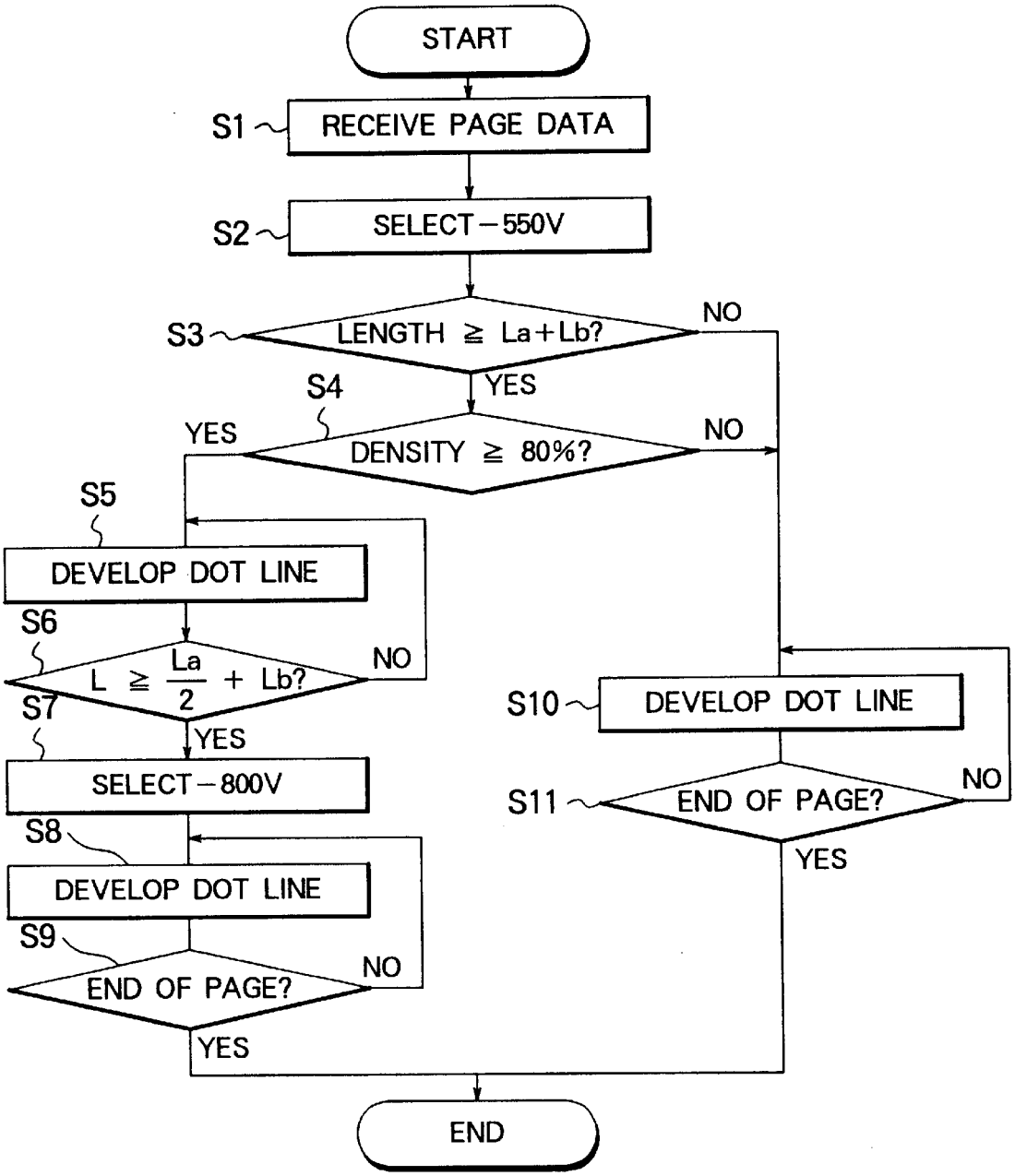
FIG. 20 is a flowchart illustrating the operation of the fifth embodiment.

Referring to FIG. 20, the first step (S1) is to receive input data describing one page to be printed, and generate a bit map of the page in the frame buffer 64. In the next step (S2), the printing controller 58 commands the power supply output controller 50 to set the dual-level power supply 48 for output of −550 V. In the next step (S3), the printing controller 58 determines whether the length of the page equals or exceeds the sum of the distance (La) traveled by a point on the circumference of the photosensitive drum 2 white the developing roller 14 makes one full turn, and the distance (Lb) traveled by a point on the circumference of the photosensitive drum 2 while the supply roller 12 makes one full turn.

If the length of the page equals or exceeds this sum (La+Lb), in the next step (S4), the density calculator 66 calculates the average density of black dots on the page, by counting the total number of black dots, and the printing controller 58 compares the density of black dots with a threshold value such as eighty percent (80%). If the length of the page equals or exceeds (La+Lb) and the average density of black dots equals or exceeds the threshold value (80%), the page is developed as shown in steps S5 to S9.

In steps S5 and S6, the image is developed up to, for example, the dot line located a distance equal to (La/2)+Lb from the top of the page, with the supply roller 12 biased at −550 V. Specifically, in step S5, the dot data for one line are transferred from the frame buffer 64 to the optical printing head 6, which illuminates the photosensitive drum 2 to form a latent electrostatic image of the dot line, and the photosensitive drum 2 turns by an amount equivalent to the height of one dot line. The supply roller 12 and developing roller 14 also turn, and toner is transferred from the developing roller 14 to the photosensitive drum 2, developing the dot line located at the point of contact between the developing rolLer 14 and photosensitive drum 2. In step S6 the printing controller 58 compares the length L of the image developed so far with (La/2)+Lb. The value of L is zero until the first dot line on the page reaches the point of contact with the developing roller 14, and thereafter increases by the height of one dot line each time step S5 is performed. Step S5 is repeated as long as L is less than (La/2)+Lb.

When the image has been developed up to a distance of (La/2)+Lb from the top of the page, in the next step (S7), the printing controller 58 commands the power supply output controller 50 to switch the dual-level power supply 48 from −550 V to −800 V. Then in the next two steps (S8 and S9), the rest of the page, from the first dot line located more than (La/2)+Lb from the top of the page to the dot line located at the end of the page, is developed with the supply roller 12 biased at −800 V.

If the page length is less than La+Lb, or the dot density is less than the threshold value (80%), the entire page is developed with the supply roller 12 biased at −550 V (steps S10 and S11).

As a result, on pages with a length of La+Lb or greater and a black-dot density equal to or greater than the threshold density (80%), just at the point where the developing roller 14 would start receiving less toner because of the sharp reduction in recycled toner, the potential difference between the supply roller 12 and developing roller 14 is increased, raising the rate at which toner is transferred from the supply roller 12 to the developing roller 14. The increased transfer rate substantially compensates for the decrease in recycled toner. The darkness of the developed image, accordingly, remains substantially constant throughout the page.

The point at which the bias potential should be switched depends on the relative geometry of the supply roller 12, the developing roller 14, arid the photosensitive drum 2. The value (La/2)+Lb given above is appropriate if the shafts of the supply roller 12, developing roller 14, and photosensitive drum 2 are aligned in a single plane. If the shafts are riot so aligned, the switching point should be altered accordingly.

The switching of the bias potential can also be controlled according to details of the image on the page. For example, if a page begins with a white border and a dark image starts below the white border, the switching can be delayed to compensate for the width of the white border.

In short, the bias potential should be switched just when the developing roller 14 begins to receive less recycled toner from the supply roller 12 because of a preceding transition from light to dark in the developed image, whether this transition occurred at the beginning of the image or at an internal point in the image.

Sixth embodiment

The sixth embodiment is similar to the fifth embodiment, but switches the rotational speed of the supply roller 12 instead of switching the bias potential.

Figure 21:
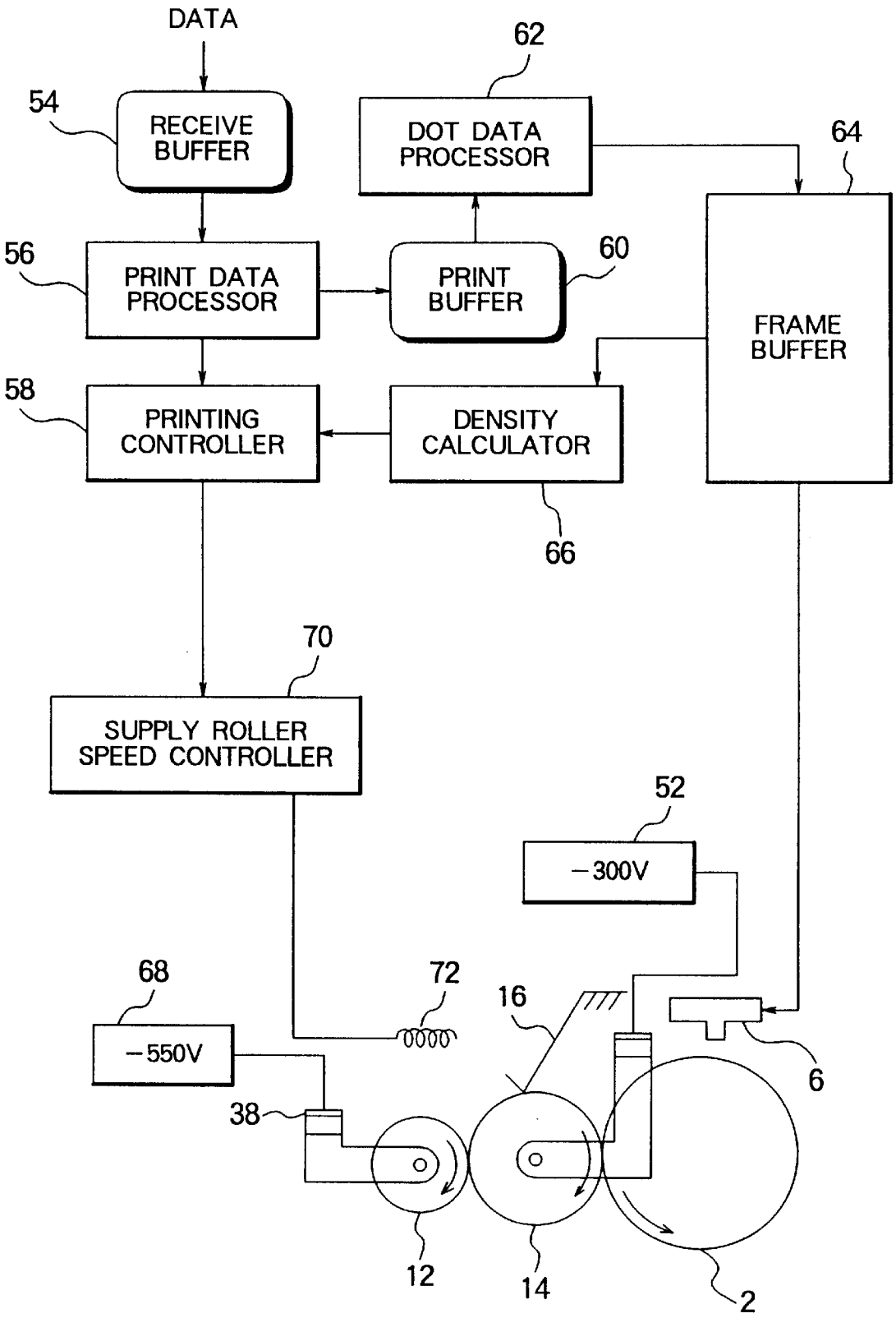
FIG. 21 schematically illustrates a sixth embodiment of the invention.

FIG. 21 illustrates the sixth embodiment, using the same reference numerals as in FIG. 19 for equivalent elements. Only the differences between FIGS. 19 and 21 will be described below.

Instead of a dual-level power supply, the sixth embodiment uses a fixed −550-V power supply 68 to bias the supply roller 12.

Instead of a power supply output controller, the sixth embodiment has a supply roller speed controller 70, which controls a plunger magnet 72. The plunger magnet 72 is an electromagnet or solenoid that controls the speed of the supply roller 12 as explained below. The supply roller speed controller 70 comprises circuits for energizing the pLunger magnet 72 in response to commands from the printing controller 58.

Figure 22:
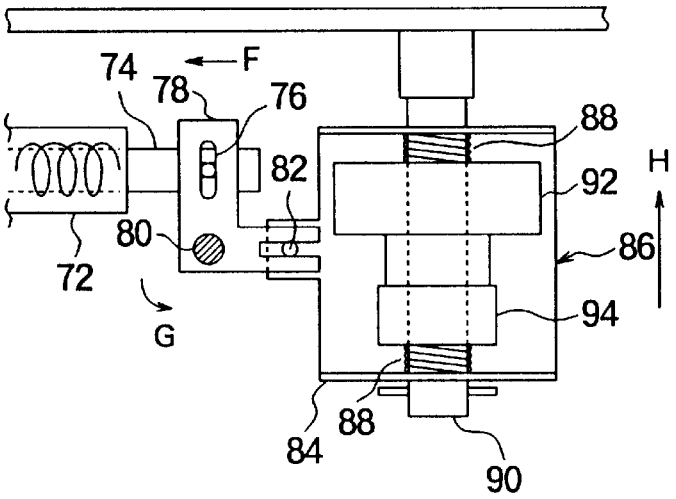
FIG. 22 illustrates the speed switching mechanism in the sixth embodiment.

Referring to FIG. 22, the plunger magnet 72 moves an iron plunger 74, which functions as the core of the plunger magnet 72. The plunger 74 has a pin 76 that engages a slot near one end of an L-shaped arm 78. The L-shaped arm 78 is supported on a pivot 80 and is free to turn as indicated by the arrow marked G. The other end of the L-shaped arm 78 has a slot that engages a pin 82 on a bracket 84, in which the idle gear 86 of the gear train that drives the supply roller 12 is mounted.

The idle gear 86 is a movable gear that is held between the ends of the bracket 84 by springs 88, and is free to slide and rotate on a shaft 90. The idle gear 86 has a large-radius toothed component 92 and a small-radius toothed component 94.

When the plunger magnet 72 is energized, the plunger 74 moves in the direction of arrow F, causing the L-shaped arm to turn in the direction of arrow G, and the bracket 84 and idle gear 86 to move in the direction of arrow 11.

Figure 23:
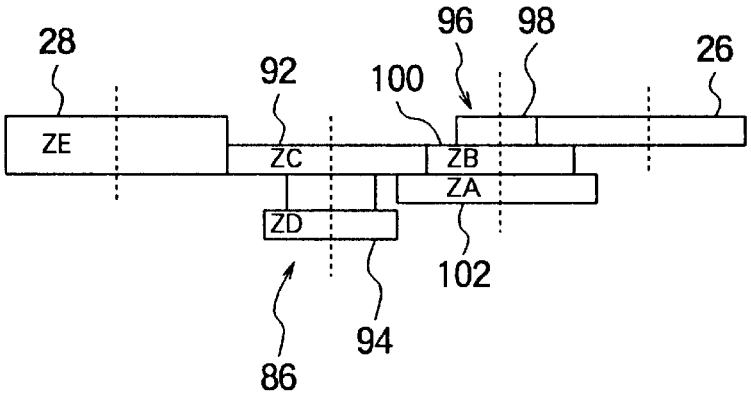
FIG. 23 illustrates the gear train in the sixth embodiment when low speed is selected.

FIG. 23 illustrates the gear train of the photosensitive drum 2, developing roller 14, and supply roller 12. The drum gear 26 and supply gear 28 are similar to the corresponding gears in the conventional developing unit shown in FIG. 2. The idle gear 86 has the structure shown in FIG. 22. The developing gear 96 has three toothed components: a small-radius component 98 that meshes with the drum gear 26, a medium-radius component 100, and a large-radius component 102. In the position shown in FIG. 23, the large-radius component 92 of the idle gear 86 meshes with both the supply gear 28 and the medium-radius component 100 of the developing gear 96. The supply gear 28 is thereby driven at a comparatively low speed.

Figure 24:
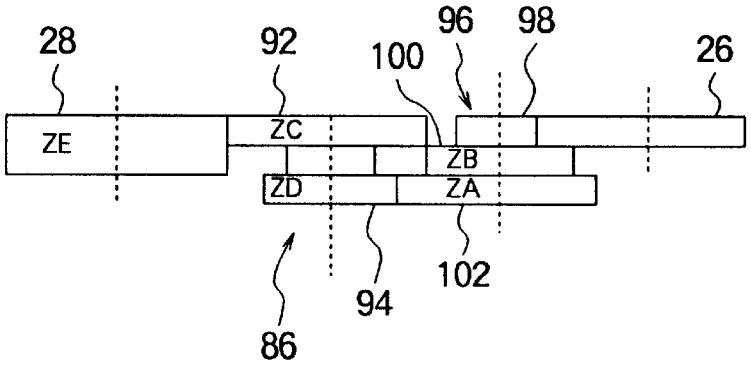
FIG. 24 illustrates the gear train in the sixth embodiment when high speed is selected.

When the idle gear is moved to the position shown in FIG. 24, the small-radius component 94 of the idle gear meshes with the large-radius component 102 of the developing gear 102, while the large-radius component 92 of the idle gear 86 still meshes with the supply gear 28. The supply gear 28 is now driven at a comparatively high speed.

Let ZA be the number of teeth of the large-radius component 102 of the developing gear 96, ZB the number of teeth of the medium-radius component 100, ZC the number of teeth of the large-radius component 92 of the idle gear 86, ZD the number of teeth of the small-radius component of the idle gear 86, and ZE the number of teeth of the supply gear 28. In the sixth embodiment, ZA is twenty-five, ZB is nineteen, ZC is twenty-five, ZD is nineteen, and ZE is thirty.

When the idle gear 86 is in the low-speed position in FIG. 23, the ratio of the rotational speed of the supply roller 12 to the rotational speed of the developing roller 14 can be calculated as follows.

$$(ZB/ZC)\cdot(ZC/ZE)=ZB/ZE=19/30\cong 0.63$$

When the idle gear 86 is in the high-speed position in FIG. 24, the rotational speed ratio is calculated as follows.

$$(ZA/ZD)\cdot(ZC/ZE)=(25/19)\cdot(25/30)=\cong 1.1$$

Moving the idle gear 86 to the high-speed position therefore speeds up the supply roller 12 by a factor of approximately 1.1/0.63, or approximately 1.7.

Next, the operation of the sixth embodiment will be described.

Figure 25:
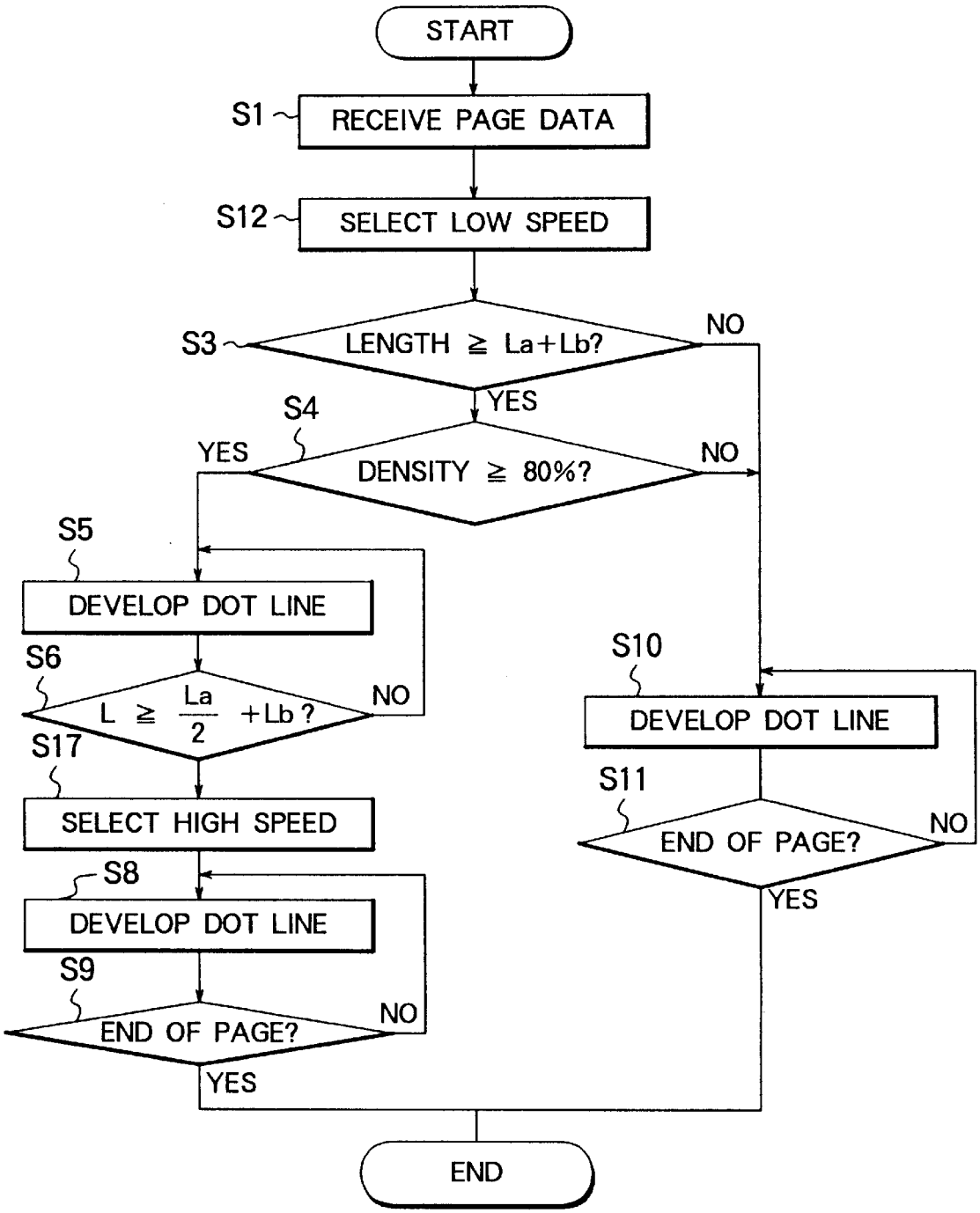
FIG. 25 is a flowchart illustrating the operation of the sixth embodiment.

Referring to FIG. 25, steps S1, S3 to S6, and S8 to S11 are the same as the corresponding steps in the fifth embodiment, the symbols L, La, and Lb having the same meaning as in FIG. 20.

In step S12, the printing controller 58 commands the supply roller speed controller 70 to select low speed. The supply roller speed controller 70 de-energizes the plunger magnet 72, setting the idle gear 86 to the position shown in FIG. 23. The first part of the page, as far as (La/2)+Lb, is always developed with the idle gear 86 in this position, the supply roller 12 turning at a comparatively slow speed.

In step S17, if the page length equals or exceeds La+Lb and the density of black dots equals or exceeds the threshold value (80%), then just before the first dot line located more than (La/2)+Lb from the top of the page is developed, the supply roller speed controller 70 energizes the plunger magnet 72, setting the idle gear 86 to the position shown in FIG. 24. The rest of the page is developed with the idle gear 86 set in this position. The supply roller 12 now turns at a higher speed, and the rate of transfer of toner from the supply roller 12 to the developing roller 14 is increased, compensating for the reduced amount of recycled toner returned from the supply roller 12 to the developing roller 14.

As in the fifth embodiment, the point at which the developing unit shifts gears can be adjusted according to the geometry of the roller shafts, so that the switching takes place just when the developing roller 14 begins to receive less recycled toner from said supply roller 12.

Seventh embodiment

Exemplifying the third aspect of the invention, the seventh embodiment employs a design in which the maximum page length is less than La+Lb.

Figure 26:
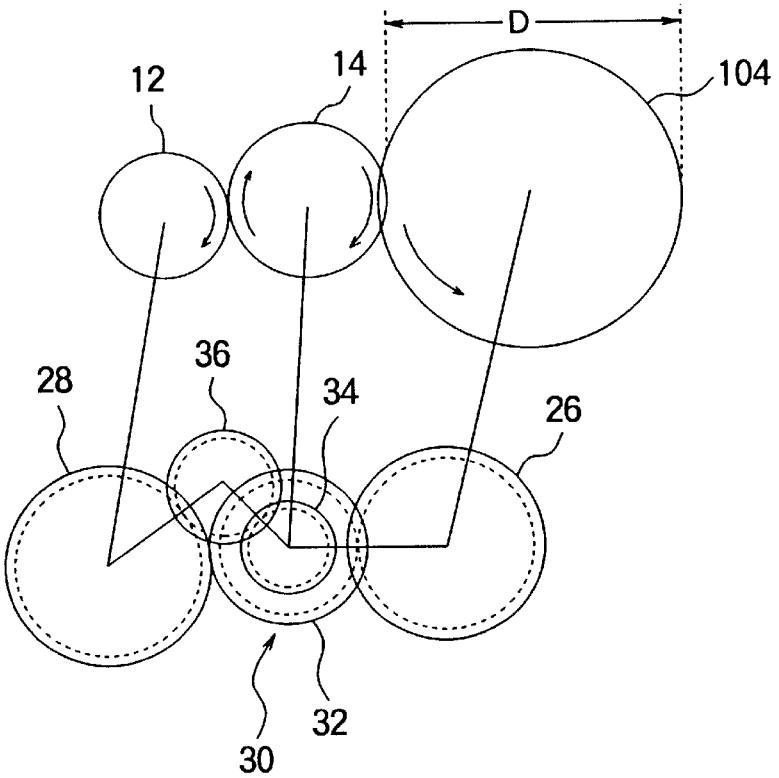
FIG. 26 schematically illustrates a seventh embodiment of the invention.

Referring to FIG. 26, the seventh embodiment is similar to the conventional developing unit illustrated in FIG. 2, except that the photosensitive drum 104 in the seventh embodiment has a larger diameter D than the conventional photosensitive drum 2.

Let MA be the number of teeth of the drum gear 26, MB the number of teeth of the supply gear 28, MC1 the number of teeth of the large-radius component 32 of the developing gear 30, MC2 the number of teeth of the small-radius component 34 of the developing gear 30, and M the number of teeth of the idle gear 36. In the seventh embodiment, MA is forty, MB is thirty, MC1 is twenty, MC2 is eighteen, and M is twenty-five. While the developing roller 14 makes one full turn, a point on the surface of the photosensitive drum 104 travels through the following distance La.

$$\begin{aligned} La &= (MC1/MA)\cdot\pi\cdot D \\ &= (20/40)\cdot\pi\cdot D \\ &= 0.5\cdot\pi\cdot D \end{aligned}$$

While the supply roller 12 makes one full turn, a point on the surface of the photosensitive drum 104 travels through the following distance Lb.

$$\begin{aligned} Lb &= (MC1/MA)\cdot(M/MC2)\cdot(MB/M)\cdot\pi\cdot D \\ &= (20/40)\cdot(25/18)\cdot(30/25)\cdot\pi\cdot D \\ &\cong 0.833\cdot\pi\cdot D \end{aligned}$$

The sum La+Lb is accordingly related to the drum diameter D as follows:

$$La+Lb=0.5\cdot\pi\cdot D+0.833\cdot\pi\cdot D\cong 1.333\cdot\pi\cdot D$$

If, for example, the maximum page Length is 297 mm, corresponding to the standard A4 paper size, the developing unit in the seventh embodiment is designed to satisfy the following inequalities:

$$1.333\cdot\pi\cdot D\geqq 297\text{ mm}\quad D\geqq 70.92\text{ mm}$$

That is, the photosensitive drum 104 has a diameter D exceeding 70.92 mm. An image on even an A4 page will then be completely developed before the amount of toner transferred from the developing roller 14 to the photosensitive drum 104 changes due to a reduction in recycled toner.

When a continuous series of pages is printed, it is still possible that a dark image on one page may lead to under-development of the image on the next page. This can be prevented, however, by switching the bias potential or rotational speed of the supply roller 12 as in the fifth or sixth embodiment. The printer is preferably controlled so that the switching takes place between pages, thereby eliminating the possibility that the switching itself might cause a visible non-uniformity in the image printed on any one page.

Eighth embodiment

The eighth embodiment is similar to the seventh embodiment, but alters the gear ratios so that the supply roller and developing roller turn more slowly, instead of altering the diameter of the photosensitive drum.

Figure 27:
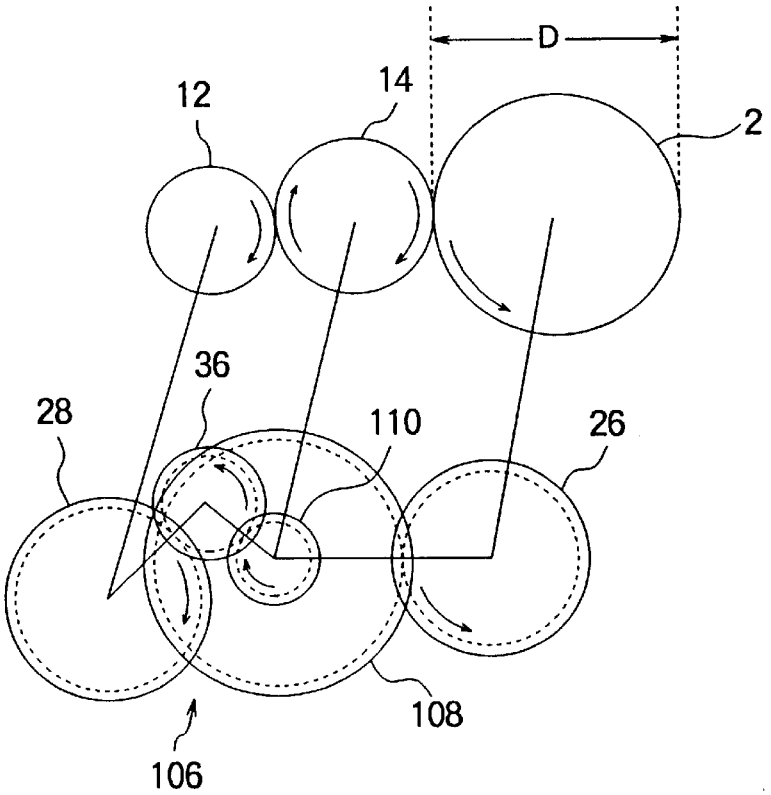
FIG. 27 schematically illustrates an eighth embodiment of the invention.

Referring to FIG. 27, the photosensitive drum 2 in the eighth embodiment has the same diameter D as in the conventional developing unit shown in FIG. 2. This diameter D is, for example, 30 mm.

The drum gear 26, supply gear 28, and idle gear 36 have the same number of teeth as in the seventh embodiment. Using the notation introduced above, MA is forty, MB is thirty, and M is twenty-five. The developing gear 106 has a large-radius component 108 with MC1 teeth and a small-radius component 110 with MC2 teeth. MC2 is eighteen, as in the seventh embodiment.

The distances La and Lb can be calculated as follows, using the relation (M/MC2)·(MB/M)=(MB/MC2).

$$\begin{aligned} La &= (MC1/MA)\cdot\pi\cdot D \\ &= (MC1/40)\cdot\pi\cdot 30\text{ mm} \\ Lb &= (MC1/MA)\cdot(MB/MC2)\cdot\pi\cdot D \\ &= (MC1/40)\cdot(30/18)\cdot\pi\cdot 30\text{ mm} \end{aligned}$$

If the maximum page Length is the A4 page length of 297 mm, the condition that La+Lb be equal to or greater than the maximum page length can be written as follows.

$$(MC\mathbf{1}/40)\cdot\pi\cdot 30+(MC\mathbf{1}/40)\cdot(\mathbf{30}/18)\cdot\pi\cdot 30\geqq 297$$

This condition is satisfied when MC1 is equal to or greater than forty-nine. More precisely, $$\mathrm{MC}\mathbf{1}\geqq 48.88$$

Thus if the large-radius component of the developing gear 108 has at least forty-nine teeth, an image on even an A4 page will be completely developed before the amount of toner transferred from the developing roller 14 to the photosensitive drum changes due to a reduction in recycled toner.

As in the seventh embodiment, changes in development darkness from one page to the next can be prevented by switching the bias potential or rotational speed of the supply roller 12.

The gear ratios and drum diameters shown in the sixth, seventh, and eighth embodiments and the bias potentials (−300 V, −550 V and −800 V) and threshold density (80%) shown in the fifth and sixth embodiments were given only as examples. These values are design parameters that can be varied as necessary when the invention is practiced.

Those skilled in the art will recognize that further variations are possible within the scope claimed below.

What is claimed is:

1. A developing unit having a toner reservoir, for developing a latent electrostatic image on an image surface, comprising:

a developing roller for carrying toner to said image surface; and at least two supply rollers for transferring toner from said toner reservoir to said developing roller and removing toner from said developing roller, said supply rollers pressing against said developing roller with a nip, and electrically charging said toner by friction at respective points of contact with said developing roller.

2. The developing unit of claim 1, wherein said developing unit is installed in an electrophotographic printer.

3. The developing unit of claim 1, wherein said supply rollers all turn in a single direction.

4. The developing unit of claim 1, wherein said supply rollers are all biased at a single electrical potential.

5. The developing unit of claim 1, wherein said supply rollers are comprised of a sponge rubber material.

6. The developing unit of claim 1, wherein said developing roller and said supply rollers are driven at a speed ratio such that surface points on said supply rollers move at different speeds from surface points on said developing roller.

7. A developing unit having a toner reservoir, for developing a latent electrostatic image on an image surface, comprising: a developing roller for carrying toner to said image surface; and at least two supply rollers making sliding contact with said developing roller, for transferring toner from said toner reservoir to said developing roller and removing toner from said developing roller, wherein said supply rollers turn in different directions.

8. A developing unit having a toner reservoir, for developing a latent electrostatic image on an image surface, comprising: a developing roller for carrying toner to said image surface; and at least two supply rollers making sliding contact with said developing roller, for transferring toner from said toner reservoir to said developing roller and removing toner from said developing roller, wherein one of said supply rollers is biased at a first electrical potential, and another one of said supply rollers is biased at a second electrical potential different from said first electrical potential.

9. A developing unit having a toner reservoir, for developing a latent electrostatic image on an image surface, comprising:

a developing roller for carrying toner to said image surface;

a supply roller making sliding contact with said developing roller, for removing toner from said developing roller, returning the toner removed from said developing roller to said developing roller as recycled toner after one rotation of said supply roller, and transferring new toner from said toner reservoir to said developing roller; and a switching means for switching a rate at which said supply roller transfers said new toner and said recycled toner to said developing roller, after said developing unit starts developing said latent electrostatic image, at a time when said developing roller begins to receive less recycled toner from said supply roller because of a preceding transition from light to dark in said latent electrostatic image.

10. The developing unit of claim 9, wherein said developing unit is installed in an electrophotographic printer.

11. The developing unit of claim 9, further comprising a density calculating means for calculating a density of said latent electrostatic image, wherein:

said switching means switches said rate only if said density exceeds a certain threshold value.

12. The developing unit of claim 9, comprising a dual-level power supply for biasing said supply roller at one of two electrical potentials as selected by said switching means, wherein:

said switching means switches said rate by switching said dual-level power supply between said two electrical potentials.

13. The developing unit of claim 9, wherein said switching means switches said rate by switching a rotational speed of said developing roller.

14. The developing unit of claim 13, further comprising a gear train with a movable gear for driving said supply roller, wherein:

said switching means switches said rate by moving said movable gear.

15. A developing unit having a toner reservoir, for developing a latent electrostatic image on an image surface, said latent electrostatic image not exceeding a certain maximum length, comprising:

a developing roller for carrying toner to said image surface; and a supply roller making sliding contact with said developing roller, for removing toner from said developing roller, returning the toner removed from said developing roller to said developing roller as recycled toner after one rotation of said supply roller, and transferring new toner from said toner reservoir to said developing roller; wherein said developing roller and said supply roller have respective rotational periods, and the rotational period of said developing roller and the rotational period of said supply roller have a sum at least as great as a time required for developing said latent electrostatic image, even if said latent electrostatic image has said maximum length.

16. The developing unit of claim 15, wherein said developing unit is installed in an electrophotographic printer.

17. The developing unit of claim 15, further comprising a switching means for switching a rate at which said supply roller transfers said new toner and said recycled toner to said developing roller, after said developing unit starts developing said latent electrostatic image, at a time when said developing roller begins to receive less recycled toner from said supply roller because of a preceding transition from light to dark in said latent electrostatic image.

18. The developing unit of claim 17, wherein said latent electrostatic image is one of a series of images printed on consecutive pages, and said switching means switches said rate only between pages.

* * * * *